US007048473B2

(12) United States Patent
Takemiya

(10) Patent No.: US 7,048,473 B2
(45) Date of Patent: May 23, 2006

(54) VIBRATION-PROOF CONSTRUCTION METHOD

(75) Inventor: Hirokazu Takemiya, Okayama (JP)

(73) Assignees: Hirokazu Takemiya, Okayama (JP); Gansui Corporation, Okayama (JP); Bridgestone Corporation, Tokyo (JP)

( * ) Notice: Subject to any disclaimer, the term of this patent is extended or adjusted under 35 U.S.C. 154(b) by 0 days.

(21) Appl. No.: 10/700,547

(22) Filed: Nov. 5, 2003

(65) Prior Publication Data

US 2004/0091316 A1 May 13, 2004

(30) Foreign Application Priority Data

Nov. 5, 2002 (JP) ..... 2002-321639

(51) Int. Cl.
*E02D 31/08* (2006.01)

(52) U.S. Cl. ..... 405/302.5; 405/231; 405/232; 52/167.7

(58) Field of Classification Search ..... 404/17, 404/27, 28, 31–36, 72, 82, 117; 405/231, 405/232, 302.4, 302.5; 248/638; 52/167.1, 52/167.4, 167.7, 167.8, 167.9, 741.15; 14/75
See application file for complete search history.

(56) References Cited

U.S. PATENT DOCUMENTS 4,242,013 A * 12/1980 Watts ..... 405/272
4,623,586 A * 11/1986 Umeya et al. ..... 428/324
4,647,258 A * 3/1987 Massarsch ..... 405/302.5
4,651,481 A * 3/1987 Csak ..... 52/167.8
4,683,691 A * 8/1987 Malzahn ..... 52/167.1
4,899,323 A * 2/1990 Fukahori et al. ..... 367/176
5,063,098 A * 11/1991 Niwa et al. ..... 428/76
5,173,012 A * 12/1992 Ortwein et al. ..... 405/302.5
5,174,082 A * 12/1992 Martin et al. ..... 52/167.2
5,669,736 A * 9/1997 Lin ..... 405/233
5,779,397 A * 7/1998 Takemiya et al. ..... 405/271
6,192,649 B1 * 2/2001 Karim-Panahi et al. .. 52/741.15
6,318,031 B1 * 11/2001 Nakamura et al. ..... 52/167.1
6,427,402 B1 * 8/2002 White ..... 52/292
6,659,691 B1 * 12/2003 Berry ..... 405/231
6,732,483 B1 * 5/2004 White ..... 52/592.1

FOREIGN PATENT DOCUMENTS

DE 1922055 B * 6/1975

(Continued)

OTHER PUBLICATIONS

Takemiya, et al., "On Vibration Reduction By Placing Used Tires as WIB," extracted from 36th Geotechnical Conference Presentation (2001 Presentation Lectures, May 8, 2001), Japanese Geotechnical Society, "Protection of Cultural Heritage from Landslides".

*Primary Examiner*—Thomas B. Will
*Assistant Examiner*—Alexandra Pechhold
(74) *Attorney, Agent, or Firm*—Sughrue Mion, PLLC

(57) ABSTRACT

A vibration-proof construction method for preventing and reducing vibration around a structure which generates vibration or receives vibration includes construction work wherein a hard member having higher stiffness than the surrounding ground and a rubber elastic member are adjacently laid underground, around or directly underneath the building structure, thereby forming a hard layer and an elastic layer. The hard member is preferably concrete, hardening-treated soil, or iron material, and the rubber elastic member is preferably scrap tires or pulverized scrap tire material. Thus, a practical and excellent vibration-proof construction method is provided, whereby even better vibration-proof effects can be obtained, and which contributes to reduction in construction costs.

26 Claims, 8 Drawing Sheets

FOREIGN PATENT DOCUMENTS

| | | | | |
|---|---|---|---|---|
| EP | 819661 | A | * | 1/1998 |
| JP | 2570340 | B | * | 2/1989 |
| JP | 2570341 | B | * | 2/1989 |
| JP | 02157326 | A | * | 6/1990 |
| JP | 03103534 | A | * | 4/1991 |
| JP | 04031510 | A | * | 2/1992 |
| JP | 04155018 | A | * | 5/1992 |
| JP | 05214843 | A | * | 8/1993 |
| JP | 08027810 | A | * | 1/1996 |
| JP | 2764696 | B2 | | 3/1998 |
| JP | 2850187 | B2 | | 11/1998 |
| JP | 11124863 | A | * | 5/1999 |
| JP | 11280087 | A | * | 10/1999 |
| JP | 2000-282501 | A | | 10/2000 |
| JP | 2000282501 | A | * | 10/2000 |
| JP | 2003090386 | A | * | 3/2003 |

* cited by examiner

CASE 1

CASE2

CASE5

CASE3

CASE4

VIBRATION-PROOF CONSTRUCTION METHOD

BACKGROUND OF THE INVENTION

1. Field of the Invention

The present invention relates to a vibration-proof construction method, more particularly to a vibration-proof construction method for preventing or reducing the vibrations from vibration generating sources such as a road, railroad structure, or the like, to surrounding structures and the ground surface, by suppressing vibration propagation directly underneath the vibration generating sources or in the nearby ground.

2. Description of the Related Art

In recent years, vibrational disturbances along side of roads, railroad structures, and the like have frequently occurred due to traffic vibration or mechanical vibration. In particular, the negative effects due to such vibrations affecting surrounding houses and residents are serious with heavy traffic or close by railway tracks, and accordingly effective and efficient countermeasures for suppressing such vibrations have been strongly demanded.

As conventionally known suppression methods, for example, there is a vibration-screening trench construction method by providing a hollow space on a propagation path of vibrations in the ground, a vibration-impeding underground wall construction method by filling in the hollow trench with a suitable material, and so forth. These construction methods are methods to obtain vibration-proofing effects by directly blockading vibrations which propagate in the ground by the hollow trench or by the underground wall, but the former method has difficulties not only in increased costs in order to perform additional construction for building soil-retaining structures or supporting members, because it is realistically impossible to retain the hollow trench as it is, but also in losing vibration-blocking effects due to the additional construction. On the other hand, the latter method does nothing but replace the hollow trench with the underground wall having a constant quality of material so as to eliminate the need to perform the additional construction in the former method, so that the latter method cannot obtain sufficient vibration-proof effects as compared with the former method.

As a solution of these problems, the present inventors have proposed an anti-vibration method (the Wave Impeding Block (WIB) construction method using horizontal blocks) for solving the problems by laying flat blocks in the underground (Japanese Patent No. 2850187 (claims, etc.)), and furthermore in a later application have proposed an improved construction method (Japanese Patent No. 2764696 U.S. Pat. No. 5,779,397 (Claims, tc.)). These techniques involve flat blocks with a predetermined size, stiffness, and depth, are laid underground beneath or around a substructure which generates vibration or receives vibration. This has been realized based upon a theory regarding wave propagation in the ground (identification method for propagation/non-propagation phenomenon of waves) which had been established by the present inventors.

Moreover, with the above-described WIB method, a problem has remained in that anti-vibration effects are low as to vibrations with a low-frequency band of below 5 Hz, and also as to earthquakes, artificial vibration sources such as traffic vibration, and so forth, in ground influenced by low-frequency bands. In order to solve this problem, the present inventors have proposed a technique to obtain anti-vibration effects as to the vibration with a low-frequency band of below 5 Hz while taking advantage of the WIB construction method (see Japanese Unexamined Patent Application Publication No. 2000-282501 (claims, etc.)).

Furthermore, the present inventors made studies to realize improvement of vibration-proof effects based upon the theory regarding wave propagation within the ground described in the foregoing Japanese Patent No. 2850187, and as a result of these studies, have found that employing a building structure which takes advantage of the physical properties of scrap tires can obtain excellent vibration-proof effects which cannot be obtained in the conventional methods, and have presented their discovery to the Society (The 36th Geotechnical Conference Presentation (2001 Presentation Lectures, May 8, 2000, Japanese Geotechnical Society))

Although any of the above-described vibration-proof construction methods proposed by the present inventors is an effective vibration suppressing method, in recent years, the required properties are being increased more and more, furthermore, suppressing construction costs including material costs has been strongly demanded more than ever.

SUMMARY OF THE INVENTION

Accordingly, it is an object of the present invention to provide a practical and excellent vibration-proof construction method wherein even better vibration-proof effects can be obtained, and also wherein contribution to reduction in construction costs can be realized.

The present inventors have intensively studied a method to improve vibration-proof effects more than ever based upon the theory regarding wave propagation within the ground described in the foregoing Japanese Patent No. 2850187, and as a result of intensive studies, have found that better vibration-proof effects than those obtained with conventional methods can be obtained by laying underground a hard member which is stiffer than the surrounding ground, and a rubber elastic member, under predetermined conditions, thereby completing the present invention.

That is to say, the vibration-proof construction method according to the present invention is a method for preventing or reducing vibration around a structure which generates vibration or receives vibration, wherein a hard member having higher stiffness than the surrounding ground and a rubber elastic member are adjacently laid underground directly underneath or around said structure, thereby forming a hard layer and a elastic layer.

With the vibration-proof construction method according to the present invention, making best use of the properties of a rubber member with a hard layer construction technique based upon the theory regarding wave propagation within the ground established by the present inventors, and perspective regarding kinetic properties of a rubber elastic member, realizes extensive improvement of damping effects for vibrational propagation in the ground. Thus, it is possible to reduce not only propagation of traffic vibrations passing through but also traffic noise extensively. Moreover, scrap tires which are actually scrap material can be used, thereby contributing to extensive reduction in construction costs. According to the present invention, a vibration-proof technique with extremely high practical value can be provided.

DESCRIPTION OF THE PREFERRED EMBODIMENTS

Figure 1:
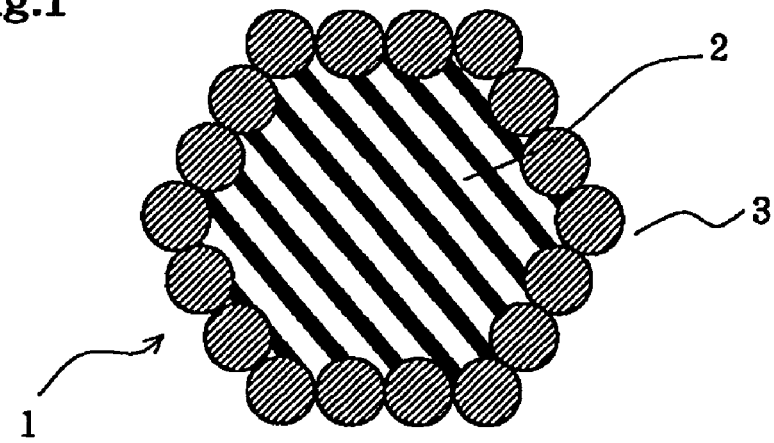
FIG. 1 is a schematic cross-sectional diagram in the horizontal direction for illustrating Construction Example 1 according to the present invention.

The following description will be made regarding embodiments according to the present invention.

The hard member employed in construction methods according to the present invention should not be restricted to any specific hard member as long as the hard member can form a hard layer with higher stiffness than that of the surrounding ground, however, from a convenience of construction, concrete, hardening-treated soil, iron material, or the like is preferably employed. In order to form a hard layer in the ground by employing these hard members, hard members in a column shape, preferably in a cylindrical column shape, or in a square column shape, should be appropriately laid underground beforehand.

The diameter and length of such a column is appropriately determined corresponding to the scale of the structure which generates vibration or receives vibration. In the event of reducing propagation of traffic vibrations passing through, from a viewpoint of vibration-proof effects and ease of construction, the diameter of the column is preferably 0.1 to 2.0 m, and more preferably 0.3 to 1.0 m. Also, the length of the column is preferably 1 to 50 m, more preferably 2 to 10 m. Also, the angle of the column to be laid in the ground is not particularly restricted, and a hard layer according to the present invention can be formed so as to obtain the desired effects regardless of whether the column is laid vertically, horizontally, or inclined, however, from a viewpoint of ease of laying columns deep in the ground, the vertical direction is preferable.

Moreover, the kinds and features of the rubber elastic member employed in the construction method according to the present invention, or the technique thereof to lay the column in the ground, should not be restricted, as long as the rubber elastic member can exhibit damping effects of vibrational propagation in the ground. From a viewpoint of effective use of waste and reduction in costs according to the present construction method, tires to be scrapped, conveyer belts, fenders, and so forth are preferably employed. Scrap tires may be any sort of tires such as a tires for automobiles, trucks, buses, bicycles, construction vehicles, and the like. Furthermore, rubber powder and spew generated in the process of manufacturing rubber products such as tires may be suitably employed.

Such scrap tires may be laid in the ground as they are, however, in order to prevent air gaps from occurring when being laid underground, scrap tires are preferably pulverized with a pulverizing method such as roll pulverizing. When regarding the pulverized material as a round shape, the diameter thereof should be determined corresponding to the scale of the structure which generates vibration or receives vibration, and from the perspective of vibration-proof effects and ease of construction and so forth, should preferably be 0.01 to 1 m, and more preferably 0.03 to 0.3 m. Note that the shape of the pulverized material is not restricted to a specific shape, and any shape, such as a dice shape, square plate shape, random shape, or the like, may employed.

In the event of forming an elastic layer in the ground employing such a pulverized material, from a viewpoint of vibration-proof effects and ease of construction, the diameter of clumps of pulverized material is preferably 0.2 through 20 m, more preferably 1 through 5 m. Also, the length (height) of clumps of crushed objects is preferably 0.3 through 20 m, more preferably 0.5 through 5 m.

The elastic layer according to the present invention is preferably formed from a rubber elastic member alone from a viewpoint of vibration-proof effects, however, the rubber elastic member may be mixed with soil, sand, gravel, and the like. In particular, in order to prevent ground settlement following construction, 90% by weight or less of soil or the like, preferably 20 through 70% by weight, should be mixed with the rubber elastic member. At this time, a rubber elastic member may be mixed with filling ground material such as soil beforehand, and then may be placed in the foregoing hard layer or the layer between the hard layers, which are formed in the construction site beforehand.

In the event of forming the elastic layer according to the present invention, elastic members employed in all the places may be the same, or may use or different kinds of pulverized materials, different sizes of a scrap tires, and the like, from place to place. Furthermore, in the event of placing pulverized materials such as scrap tires in the ground, each clump of a pulverized material may be wrapped beforehand with a bonded textile, a geogrid, or the like, in order to improve ease of construction.

Next, specific description regarding preferred construction examples of the vibration-proof construction method according to the present invention will be made.

CONSTRUCTION EXAMPLE 1

With the present preferred construction example shown in FIG. 1, schematically illustrating a cross-sectional view in the horizontal direction, a hard layer 1 is formed by driving multiple cylindrical columns 3 such that a horizontal cross-sectional shape becomes a honeycomb shape, following which an elastic layer 2 is formed by placing the for going rubber elastic member in the hard layer 1. Here, the hard layer 1 denotes the entire region formed with the multiple cylindrical columns 3. This honeycomb shape is used as a basic unit, which is appropriately placed in the ground directly underneath or around the structure which generates vibration or receives vibration. The number of cylindrical columns in one unit is preferably 5 to 50, more preferably 8 to 30, from a viewpoint of vibration-proof effects and ease of construction and the like.

Figure 2:
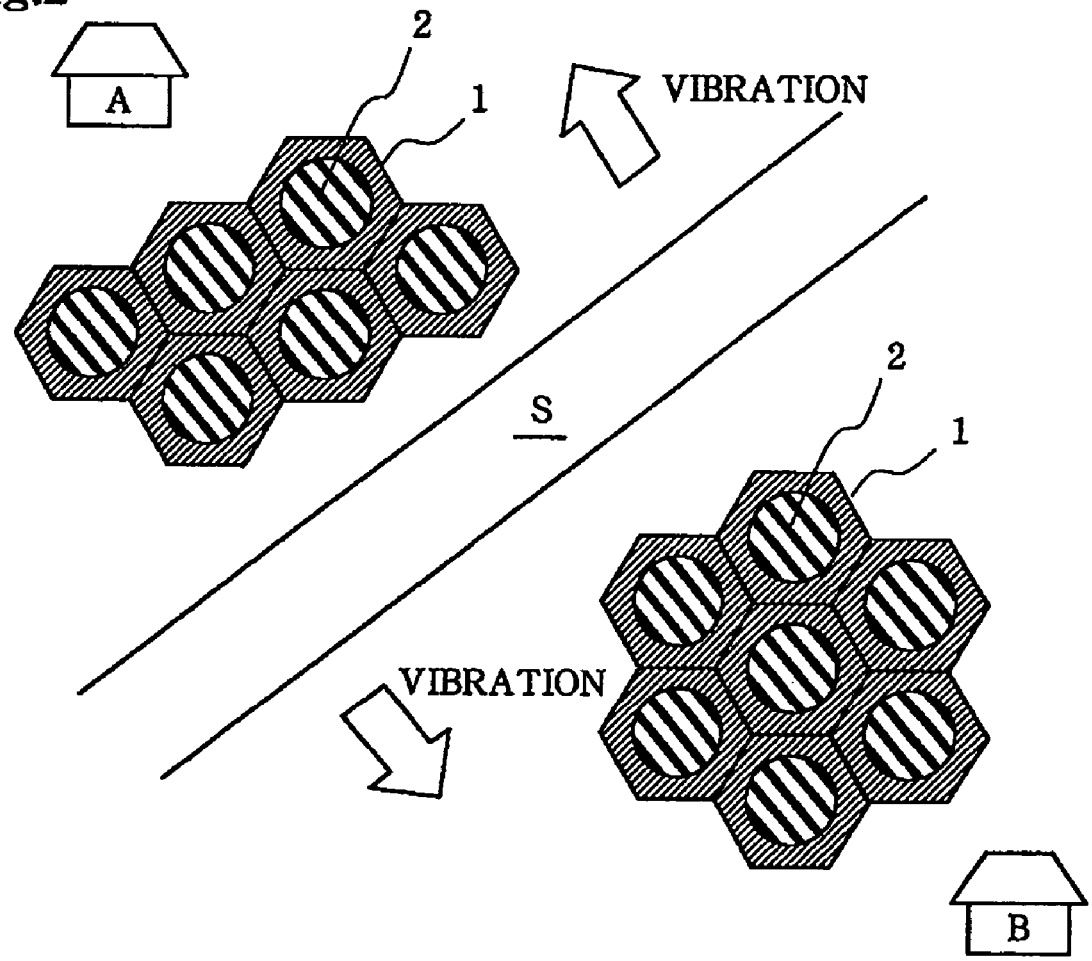
FIG. 2 is an explanatory diagram for describing specific construction in the aforementioned Construction Example 1.

As shown in FIG. 2 schematically illustrating a cross-sectional view in the horizontal direction, when there are private residences A and B near a vibrating source S such as a road, a railroad, or the like, vibration-proof construction which uses the aforementioned honeycomb shape for a basic unit is performed between the vibrating source S and the private residence A, and between the vibrating source S and the private residence B, respectively. The number of units and the shape of combination should be determined according to the distance between the vibrating source and the private residence and the kind of vibrating source. Furthermore, it is also possible to dispose the units without interval, or to dispose the units somewhat distanced from each other. For example, in the preferred construction example shown in the drawing, 6-unit honeycomb-shaped vibration-proof construction is performed between the vibrating source S and the private residence A, and also 7-unit honeycomb-shaped vibration-proof construction is performed between the vibrating source S and the private residence B far from the vibrating source S. Thus, multiple-unit honeycomb-shaped vibration-proof construction is performed, thereby decaying vibrational propagation in conjunction with the honeycomb-shaped hard layer 1, further, decaying vibrational propagation exponentially under the influence of the elastic layer 2.

Although the foregoing honeycomb shape is the most preferred construction shape, the construction feature is not restricted to this, and accordingly the following other construction features can also be preferably employed.

CONSTRUCTION EXAMPLE 2

Figure 3:
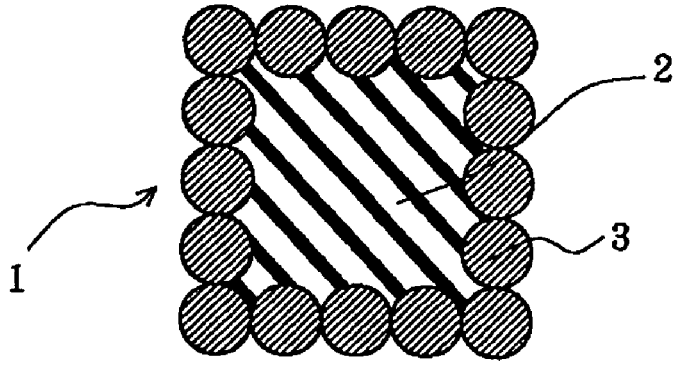
FIG. 3 is a schematic cross-sectional diagram in the horizontal direction for illustrating Construction Example 2.

With the present preferred construction example, shown in FIG. 3 schematically illustrating a cross-sectional view in the horizontal direction, a hard layer 1 is formed by driving multiple cylindrical columns 3 such that a horizontal cross-sectional shape becomes a square shape, following which an elastic layer 2 is formed by placing the foregoing rubber elastic member in the hard layer 1. This square shape is used as a basic unit, which is appropriately placed in the ground directly underneath or around the structure which generates vibration or receives vibration. The number of cylindrical columns in one unit is preferably 5 through 50, more preferably 8 through 30, from a viewpoint of vibration-proof effects and ease of construction, as with the case of the honeycomb-shaped basic units in the foregoing Construction Example 1.

Figure 4:
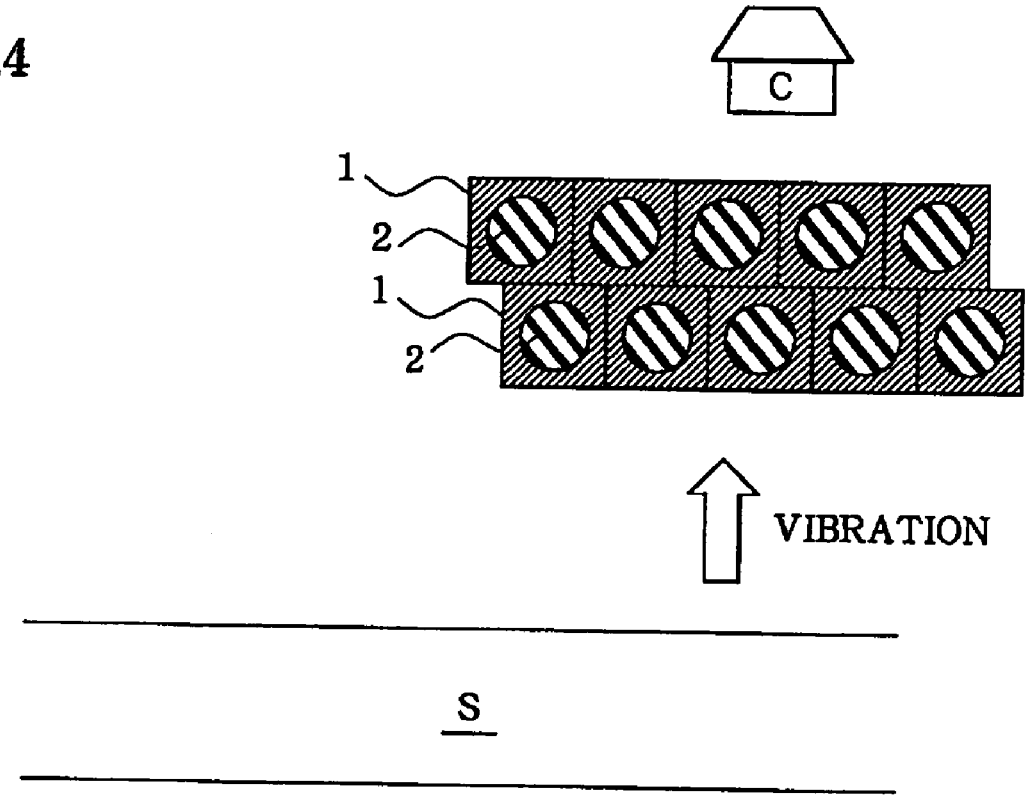
FIG. 4 is an explanatory diagram for describing specific construction in the aforementioned Construction Example 2.

In FIG. 4, when there is a private residence C near a vibrating source S such as a road, a railroad, or the like, vibration-proof construction which uses the aforementioned square shape for a basic unit is performed between the vibrating source S and the private residence C. With the preferred construction example shown in FIG. 4 schematically illustrating a cross-sectional view in the horizontal direction, while square basic units are arrayed in two rows, the number of units and the layout should be appropriately determined according to the kind of the vibrating source S, the distance between the vibrating source S and the private residence C, and the like.

CONSTRUCTION EXAMPLE 3

Figure 5:
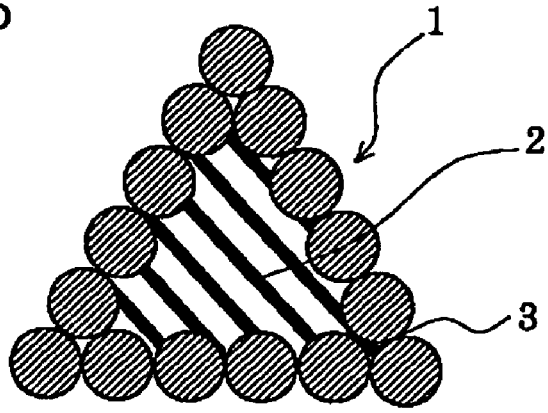
FIG. 5 is a schematic cross-sectional diagram in the horizontal direction for illustrating Construction Example 3.

With the present preferred construction example shown in FIG. 5 schematically illustrating a cross-sectional view in the horizontal direction, a hard layer 1 is formed by driving multiple cylindrical columns 3 such that a horizontal cross-sectional shape becomes a triangular shape, following which an elastic layer 2 is formed by placing the foregoing rubber elastic member in the hard layer 1. This triangular shape is used as a basic unit, which is appropriately placed in the ground around the structure which generates vibration or receives vibration. The preferred number of cylindrical columns in one unit is the same as with the case of the foregoing construction examples.

Figure 6:
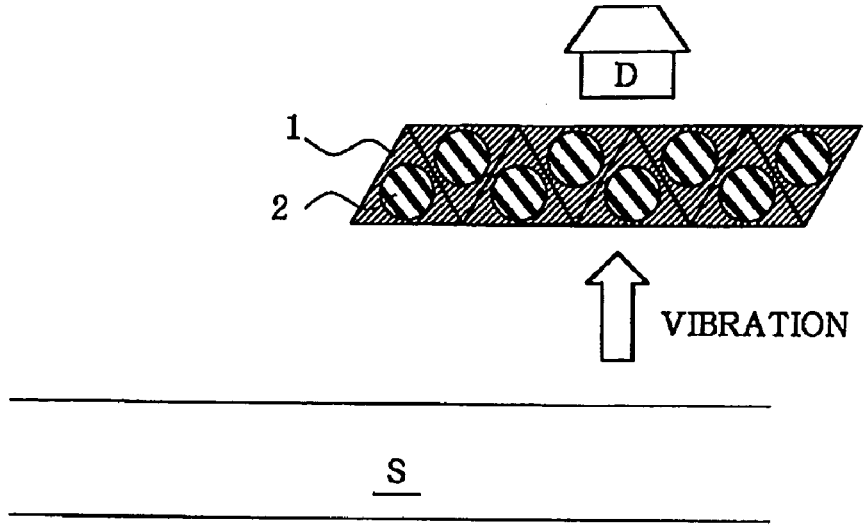
FIG. 6 is an explanatory diagram for describing specific construction in the aforementioned Construction Example 3.

In FIG. 6, when there is a private residence D near a vibrating source S such as a road, a railroad, and the like, vibration-proof construction which uses the aforementioned triangular shape for a basic unit is performed between the vibrating source S and the private residence D. With the preferred construction example shown in FIG. 6 schematically illustrating a cross-sectional view in the horizontal direction, while triangular basic units are alternately arrayed in a zigzag row along a straight line, the number of units and the shape of combination should be appropriately determined according to the distance between the vibrating source S and the private residence D, the kind of the vibrating source S, and the like.

CONSTRUCTION EXAMPLE 4

Figure 7:
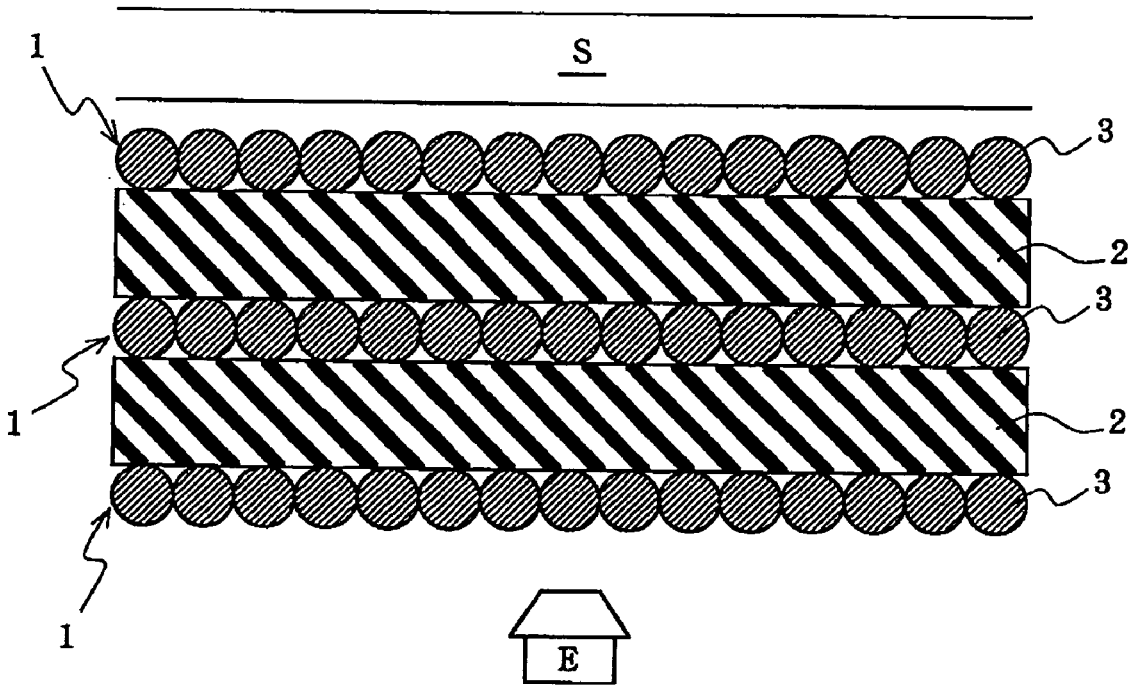
FIG. 7 is an explanatory diagram for describing specific construction in Construction Example 4 according to the present invention.

With the present preferred construction example shown in FIG. 7 schematically illustrating a cross-sectional view in the horizontal direction, hard layers 1 are formed by driving multiple cylindrical columns 3 in 3 rows such that a horizontal cross-sectional shape becomes three linear hard layers 1, following which elastic layers 2 are formed by placing rubber elastic members between the hard layers 1.

In FIG. 7, when there is a private residence E near a vibrating source S such as a road, a railroad, and the like, vibration-proof construction made up of 3-row hard layers 1 and 2-row elastic layers 2 therebetween is performed between the vibrating source S and the private residence E, however, the number of rows may be 10 or more, further, the number of cylindrical columns 3 forming the hard layers 1 may exceed 10,000. These numbers should be determined according to the distance between the vibrating source S and the private residence E and the kind of the vibrating source S.

CONSTRUCTION EXAMPLE 5

Figure 8A:
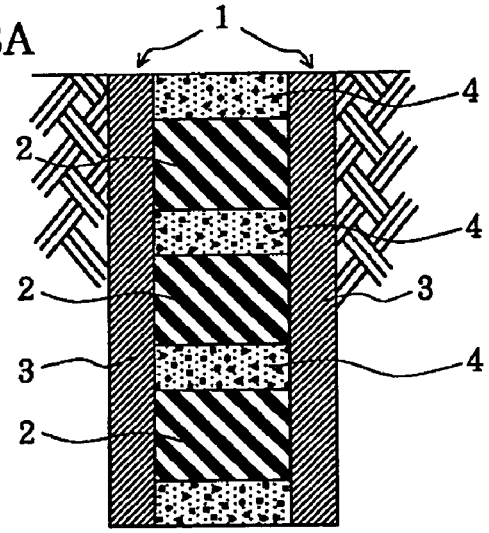
FIGS. 8A and 8B are explanatory diagrams for describing specific construction in Construction Example 5 according to the present invention.
Figure 8B:
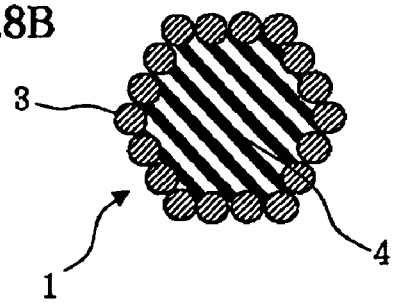

With the preferred construction examples shown in FIGS. 8A and 8B, the elastic layer 2 in a basic unit of which horizontal cross-sectional shape is a honeycomb shape, as shown in FIG. 8B schematically illustrating a cross-sectional view in the horizontal direction, and a hard layer 4 having the same stiffness as with the surrounding ground, are alternatively disposed in the vertical direction, as shown in FIG. 8A schematically illustrating a cross-sectional view in the vertical direction. A ground material for filling, such as soil, sand, gravel, and the like, can be employed as the hard layer 4 having the same stiffness as with the surrounding ground. With a basic unit made up of the hard layers 4 having the same stiffness as with the surrounding ground and the elastic layers 2, the number of layers, the thickness in the depth direction, and the like, should be determined according to the kind of vibrating source, the distance between the vibrating source and private residence, and so forth. For example, the elastic layer 2 may be made of a single layer. Also, the shape of a basic unit is not restricted to a honeycomb shape, and shapes according to the foregoing construction examples can be appropriately selected.

With an elastic layer having such a layer configuration, excellent vibration-proof effects can be obtained as to vibrations in a specific frequency band.

CONSTRUCTION EXAMPLE 6

Figure 9A:
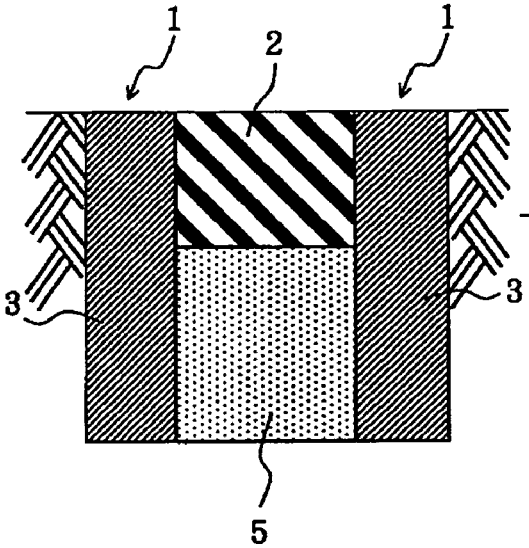
FIGS. 9A and 9B are explanatory diagrams for describing specific construction in Construction Example 6 according to the present invention.
Figure 9B:
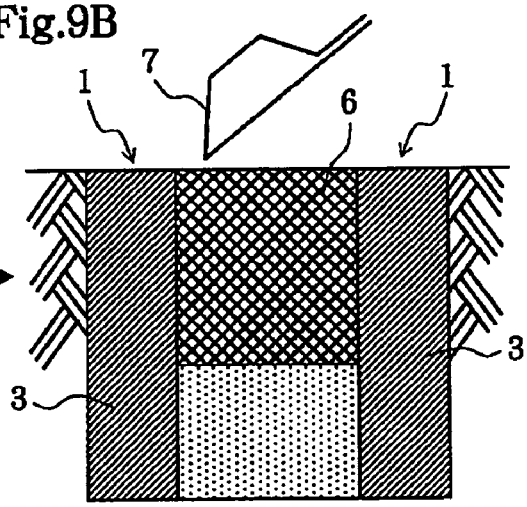

With the present preferred construction example shown in FIGS. 9A and 9B schematically illustrating a cross-sectional view in the vertical direction, the bottom of an elastic layer surrounded by hard layers 1 is formed of a ground material for filling such as soil, sand, gravel or the like, on which an elastic layer 2 is formed by placing the foregoing rubber elastic member as shown in FIG. 9A, following which a mixed layer 6 is formed by stirring in a rubber elastic member and soil at the bottom thereof with a power shovel as shown in FIG. 9B.

Thus, soil, sand, gravel and the like can be appropriately mingled with the elastic layer according to the present invention, thereby preventing ground settlement following construction without reducing vibration-proof effects.

CONSTRUCTION EXAMPLE 7

Figure 10A:
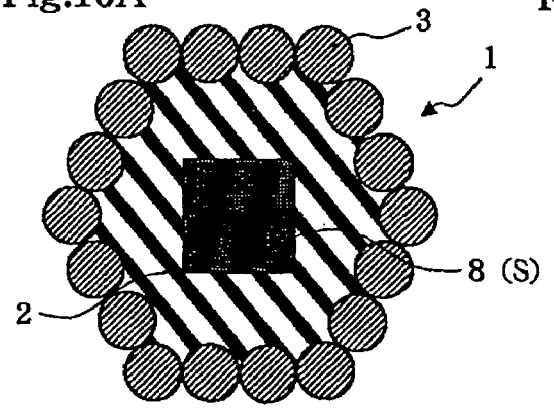
FIGS. 10A and 10B are explanatory diagrams for describing specific construction in Construction Example 7 according to the present invention.
Figure 10B:
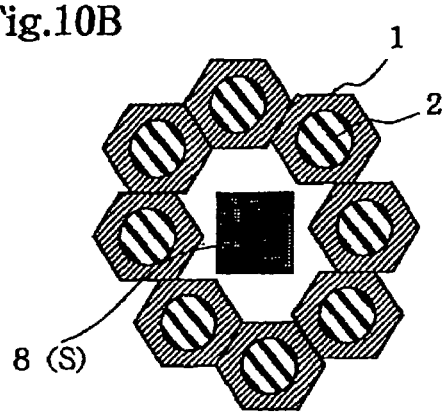

The present preferred construction example shown in FIGS. 10A and 10B schematically illustrating a cross-sectional view in the horizontal direction is a case of a vibrating source S being a foundation or a support of such as a bridge or an elevated structure or the like. In FIG. 10A, a hard layer 1 is formed by driving multiple cylindrical columns 3 such that a horizontal cross-sectional shape around a support 8 having a cross-sectional square shape serving as a vibrating source S becomes a honeycomb shape, and then an elastic layer 2 is formed by placing a rubber elastic member between the support 8 and the hard layer 1. Vibration-proof effects can be further improved by disposing the multiple similar honeycomb shapes around this honeycomb shape. The formation of honeycomb shapes can be performed as with Construction Example 1.

In FIG. 10B, construction shown in the foregoing Construction Example 1 is performed around the support 8 in a cross-sectional square shape which is the vibrating source S, with 8 honeycomb-shaped basic units continuously circularly arrayed. With the preferred construction example shown in the drawing, while 8 honeycomb shapes are formed around the support, even more honeycomb shapes may be continuously arrayed around thereof, thereby improving damping effects for vibrational propagation.

Figure 11:
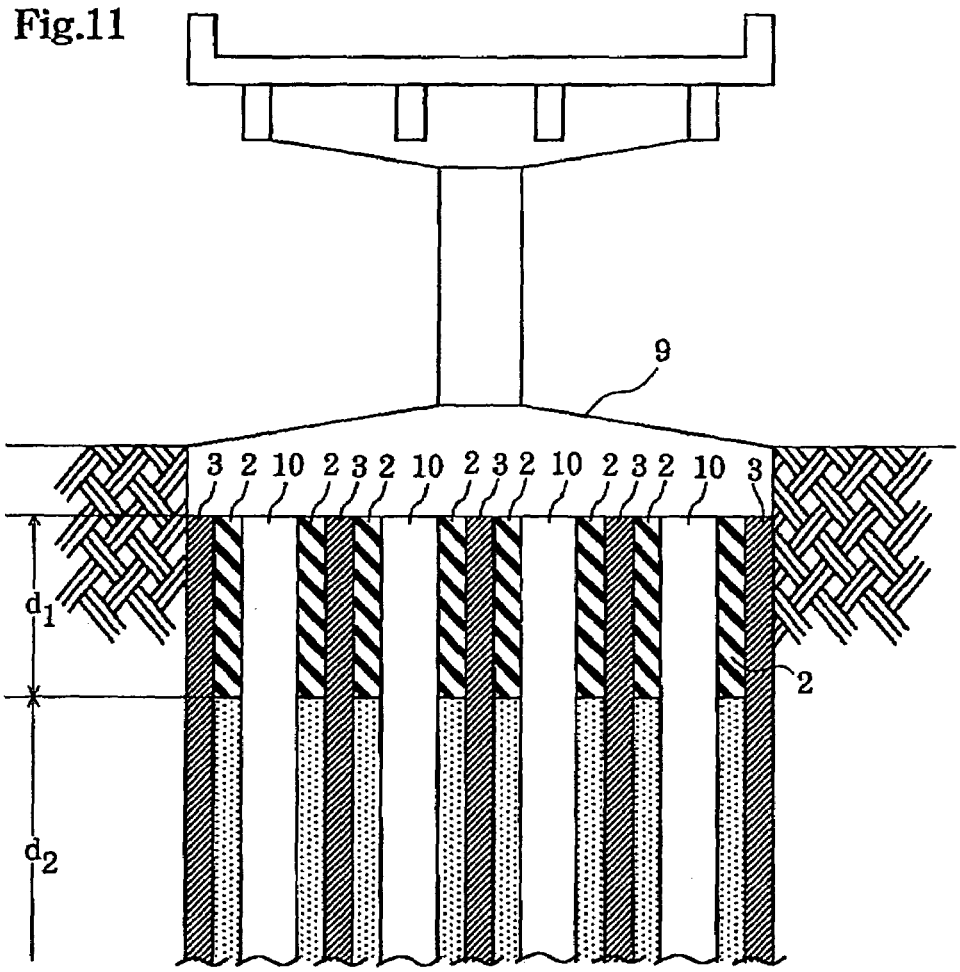
FIG. 11 is a schematic cross-sectional diagram in the vertical direction for applying Construction Example 7 according to the present invention to the position directly underneath an expressway.
Figure 12:
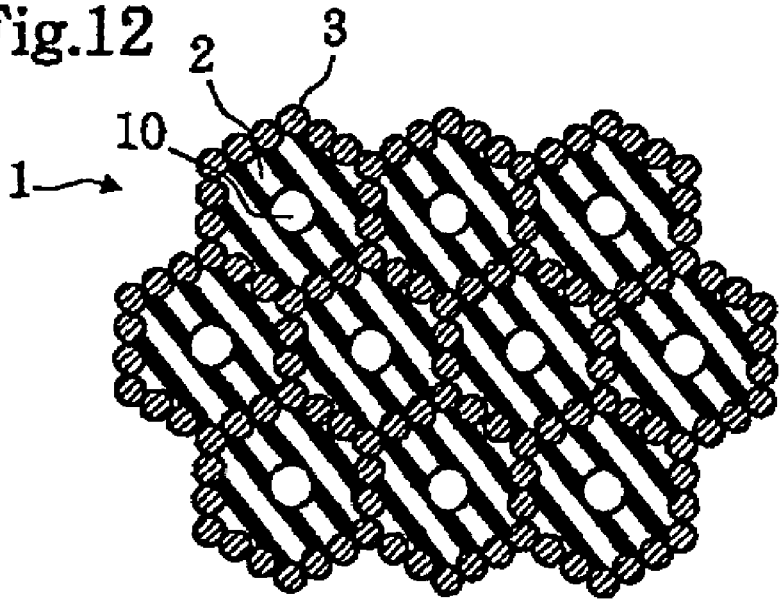
FIG. 12 is a schematic cross-sectional diagram in the horizontal direction at the level on the elastic layer shown in FIG. 11.

For example, with an expressway of which a cross-sectional view in the vertical direction is shown in FIG. 11, the vibration-proof construction method according to the present invention is performed as to a pile 10 at the bottom of a footing 9 supporting bridge piers of the expressway. The elastic layer 2 is formed around the pile 10, around which hard layers are formed with the cylindrical columns 3. FIG. 12 schematically illustrates a cross-sectional view in the horizontal direction of portions in which the elastic layers 2 are formed. As shown in FIG. 12, ten piles 10 which are driven in at the bottom of the footing 9, are each surrounded by honeycomb-shaped basic units. With regard to the depth $d_1$ of the rubber elastic layer, half or less of the depth $d_2$ of the cylindrical column 3 is sufficient to obtain the desired effects. The vibration of an expressway is the largest within a range of several meters around the footing 9, so the foregoing construction method according to the present invention is markedly effective.

The present invention will now be described based upon the following embodiments.

FIRST EMBODIMENT

The following experiment was performed with regard to a construction method according to Construction Example 1 shown in FIG. 1.

First, 18 concrete cylindrical columns (diameter: 50 cm, length: 5 m, distance between opposing sides in a honeycomb shape: 2.08 m) 3 serving as ground improvement piles were employed in an experimental site (soft ground with an N value of 10 or less) so that the horizontal cross-sectional shape became a honeycomb shape (see FIG. 1), thereby forming a hard layer 1. Next, an elastic layer 2 was formed by placing pulverized tire (pieces with diameters of 5 through 8 cm, formed by cutting scrap tires) having excellent damping effects, in the inner side of the obtained honeycomb shape.

Figure 13:
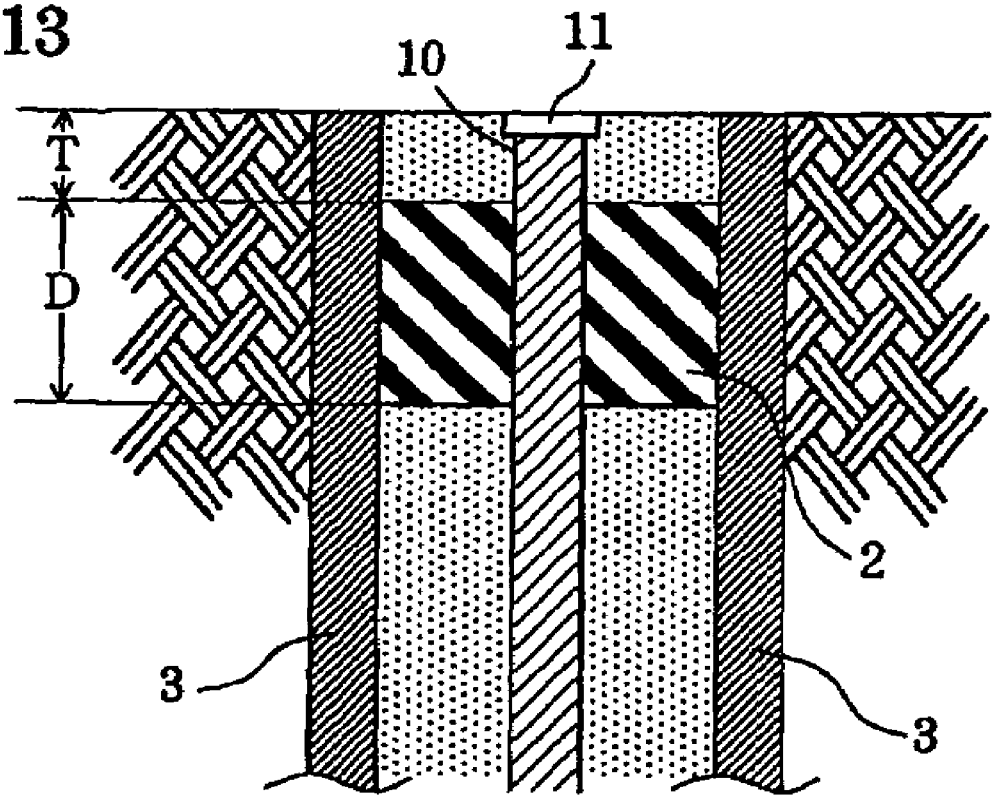
FIG. 13 is a schematic cross-sectional diagram in the vertical direction of the construction method according to a first embodiment.
Figure 14A:
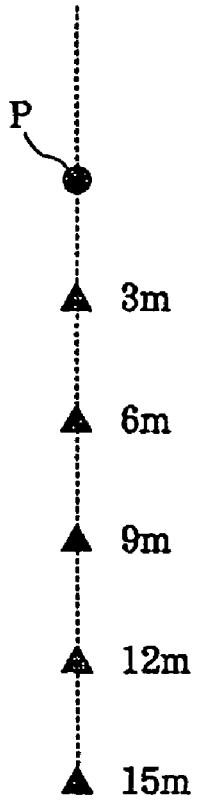
FIGS. 14A through 14E are explanatory diagrams for describing an impact test according to a second embodiment.
Figure 14B:
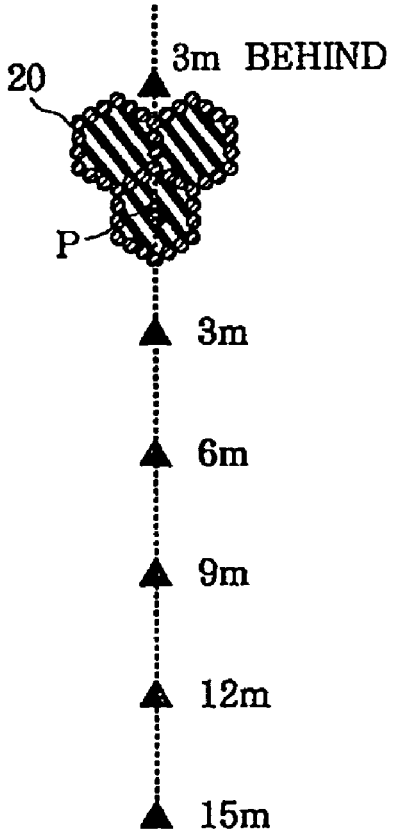
Figure 14E:
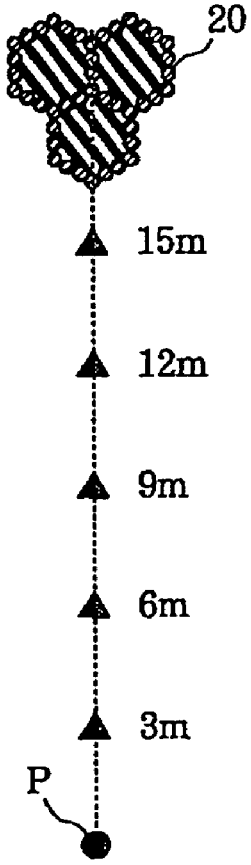
Figure 14C:
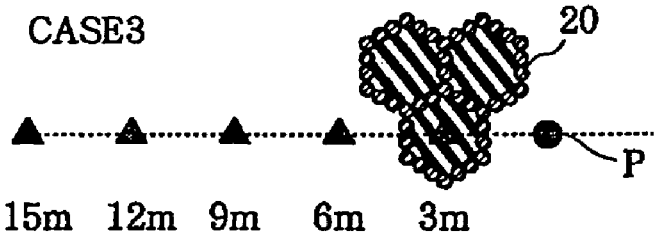
Figure 14D:
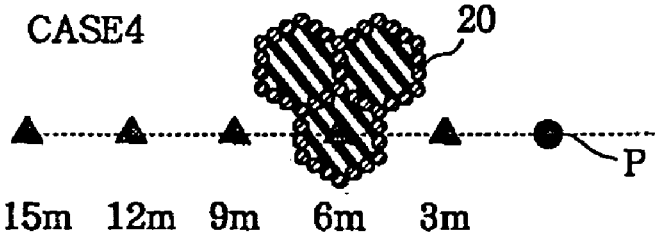

A cross-sectional view in the vertical direction according to this construction method is shown in FIG. 13. As shown in the drawing, the depth D of the elastic layer 2 formed by placing pulverized tire material was 1.0 m, and a soil layer with depth T of 0.3 m was formed at the upper portion thereof.

In order to evaluate the damping effects of this construction method with an impact test, an internal pile 10 was laid underground at a general central portion inside of the honeycomb shape formed by the ground improvement pile 3, and a velocity-type vibration sensor 11 was disposed at the pile head thereof. Response to free vibration of the surrounding ground was measured with a field impact test of this internal pile head. As a result of evaluating logarithmic decrement from measured waves, the decay ratio was around 8% during horizontal excitation and around 4% during vertical excitation.

SECOND EMBODIMENT

In this embodiment, construction was performed such that a honeycomb shape was made by combining 3 honeycomb shapes formed in the construction method according to the first embodiment (hereafter referred to as "the present construction method"). The damping effects of this construction method were evaluated with an impact test employing a guide hammer (a hammer weight; 70 kg, an impact source is attached to the tip of an arm(70 cm) with a hinge structure). In this test, with regard to each loading position (excitation point), cases were grouped as shown in FIGS. 14A through 14E. The layout of excitation points and measuring points according to Cases 1 through 5 are shown in FIGS. 14A through 14E. In the drawings, 20 denotes a honeycomb construction according to the present invention, P denotes the excitation point, and the triangle marks denote measurement points.

Case 1, Case 2 and Case 4 are cases of directly loading on the head of a steel pipe pile, while on the other hand, Case 3 and Case 5 are cases of directly loading on the ground surface at a site. The Case 2, Case 3, and Case 4 are relevant to the present construction method, while Case 1 and Case 5 are just for comparison with the present construction method. For setting the guide hammer, two directions are employed; one for vertical loading and the other for horizontal loading.

Figure 15:
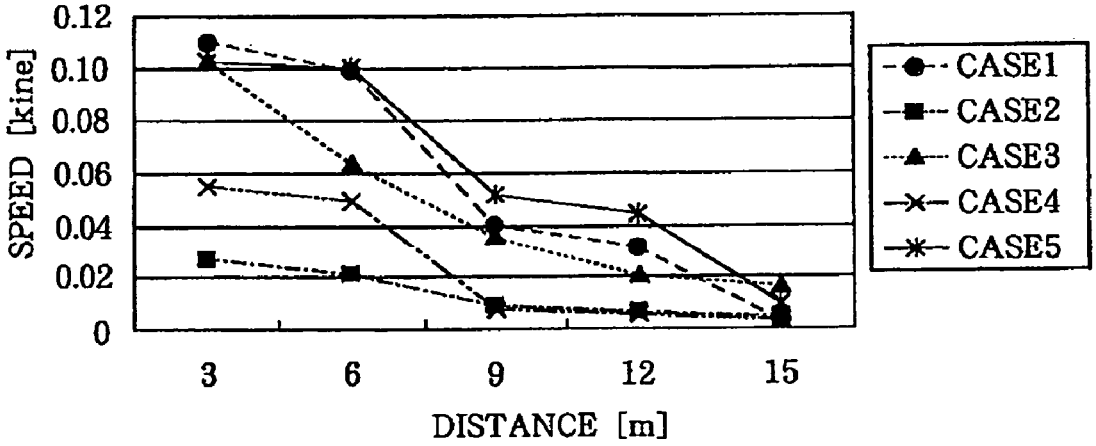
FIG. 15 is a chart for illustrating the maximum response (velocity) amplitude of vertical directional components by vertical excitation according to the second embodiment.
Figure 16:
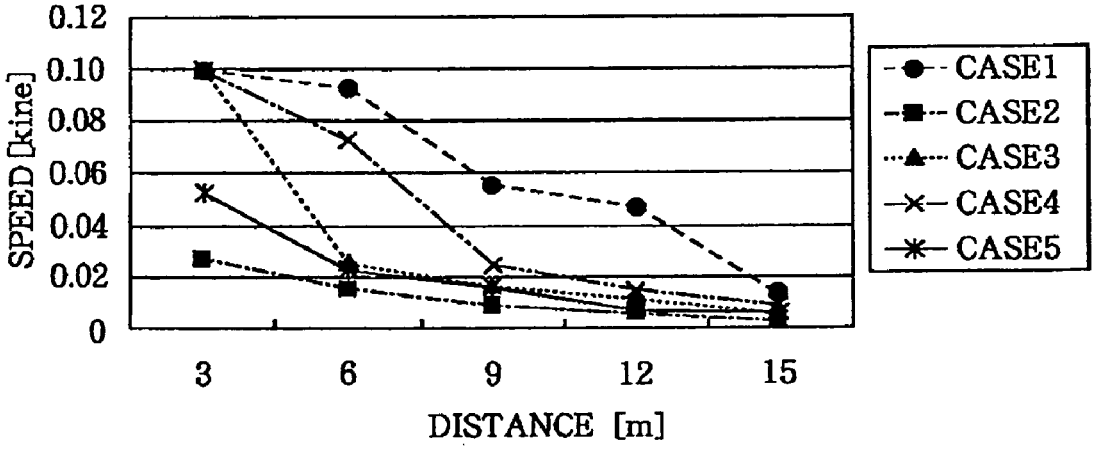
FIG. 16 is a chart for illustrating th maximum response (velocity) amplitude of in-plane directional components by excitation within a horizontal plane according to the second embodiment.

FIG. 15 shows the measured results of velocity response in the vertical direction due to the vertical impact loading, and also FIG. 16 shows the measured results of velocity response in the in-plane direction due to the horizontal impact loading. The following can be understood from these figures. First, comparing Case 1 with Case 2 allows reduction effects of response to be confirmed when the present construction method is employed. Moreover, it is clearly understood with reference to FIGS. 15 and 16 that the present construction method proves the effects of the present invention from specific responses corresponding to vertical and horizontal loading. Furthermore, comparing Case 3 with Case 4, and Case 3 with Case 5, shows that the reduction effects of response can be obtained when construction is performed on the path of vibrational propagation, employing the present construction method. Consequently, it can be understood that by the present construction method the vibration propagated far from the constructing position is significantly reduced.

What is claimed is:

1. A method for preventing or reducing vibration around a structure which generates vibration or receives vibration, the method comprising disposing a plurality of adjoining column members and an elastic member underground directly underneath or around said structure, said column members forming a hard layer contiguous with said elastic member, wherein said column members have a greater stiffness than the surrounding ground.

2. A method according to claim 1, wherein said column members are formed from concrete, hardening-treated soil, or iron material.

3. A method according to claim 1, wherein said hard layer formed by said column members surrounds said elastic material.

4. A method according to claim 3, wherein a cross sectional shape of said column members is cylindrical or square.

5. A method according to claim 1, wherein said elastic member is formed from scrap tires or pulverized scrap tire material.

6. A method according to claim 1, wherein said hard layer formed by said column members surrounds said elastic layer and a cross-sectional shape of said hard layer is hexagonal.

7. A method according to claim 1, wherein said hard layer formed by said column members surrounds said elastic layer and a horizontal cross-sectional shape of said hard layer is square.

8. A method according to claim 1, wherein said hard layer formed by said column members surrounds said elastic layer and a horizontal cross-sectional shape of said hard layer is triangular.

9. A method according to claim 1, wherein said hard layer is formed by two rows of said column members disposed on opposite sides of said elastic layer.

10. A method according to claim 1, wherein a second hard layer having the same stiffness as the surrounding ground and said elastic layer are alternately disposed in the vertical direction.

11. A method according to claim 1, wherein said rubber elastic member is mixed with the soil.

12. A method according to claim 1, wherein said structure is a support or foundation of a bridge or elevated structure.

13. A method according to claim 1, wherein said elastic member and said hard layer formed by said column members form a basic unit, and a plurality of basic units are arranged in a contiguous manner underground directly underneath or around said structure.

14. A system for preventing or reducing vibration around a structure which generates vibration or receives vibration, the system comprising:

an elastic member;

a plurality of adjoining column members disposed around a periphery of said elastic member, said column members forming a hard layer contiguous with said elastic member, wherein said elastic member and said column members are disposed underground directly beneath or around said structure, said column members have a greater stiffness than the surrounding ground.

15. A system according to claim 14, wherein said column members are formed from concrete, hardening-treated soil, or iron material.

16. A system according to claim 14, wherein said hard layer formed by said column members surrounds said elastic material.

17. A system according to claim 16, wherein a cross sectional shape of said column members is cylindrical or square.

18. A system according to claim 14, wherein said elastic member is formed from scrap tires or pulverized scrap tire material.

19. A system according to claim 14, wherein said hard layer formed by said column members surrounds said elastic layer and a cross-sectional shape of said hard layer is hexagonal.

20. A system according to claim 14, wherein said hard layer formed by said column members surrounds said elastic layer and a horizontal cross-sectional shape of said hard layer is square.

21. A system according to claim 14, wherein said hard layer formed by said column members surrounds said elastic layer and a horizontal cross-sectional shape of said hard layer is triangular.

22. A system according to claim 14, wherein said hard layer is formed by two rows of said column members disposed on opposite sides of said elastic layer.

23. A system according to claim 14, wherein a second hard layer having the same stiffness as the surrounding ground and said elastic layer are alternately disposed in the vertical direction.

24. A system according to claim 14, wherein said rubber elastic member is mixed with the soil.

25. A system according to claim 14, wherein said structure is a support or foundation of a bridge or elevated structure.

26. A system according to claim 14, wherein said elastic member and said hard layer formed by said column members form a basic unit, and a plurality of basic units are arranged in a contiguous manner underground directly underneath or around said structure.

* * * * *